US006840059B2

(12) United States Patent
Bonifacio

(10) Patent No.: US 6,840,059 B2
(45) Date of Patent: Jan. 11, 2005

(54) FASTENING FOR EARRINGS

(75) Inventor: Gérard Bonifacio, Neuilly-sur-Seine (FR)

(73) Assignee: Etablissements Charles Garnier, Paris (FR)

( * ) Notice: Subject to any disclaimer, the term of this patent is extended or adjusted under 35 U.S.C. 154(b) by 0 days.

(21) Appl. No.: 10/050,720

(22) Filed: Jan. 16, 2002

(65) Prior Publication Data

US 2002/0095953 A1 Jul. 25, 2002

(30) Foreign Application Priority Data

Jan. 19, 2001 (FR) ..... 01 00717

(51) Int. Cl.[7] ..... A44C 7/00
(52) U.S. Cl. ..... 63/12
(58) Field of Search ..... 63/12, 13, 35

(56) References Cited

U.S. PATENT DOCUMENTS

| | | | | | |
|---|---|---|---|---|---|
| 245,297 | A | * | 8/1881 | Heckmann | 63/12 |
| 271,121 | A | * | 1/1883 | Riley et al. | 63/12 |
| 355,007 | A | * | 12/1886 | Dreyfus | 63/13 |
| 3,446,033 | A | * | 5/1969 | Driscoll | 63/12 |
| 3,575,013 | A | | 4/1971 | Chernow et al. | |
| 3,933,009 | A | | 1/1976 | Ireland | |
| 4,249,393 | A | * | 2/1981 | Ciambra | 63/12 |
| 4,841,745 | A | * | 6/1989 | Hudson | 63/12 |
| 4,944,164 | A | * | 7/1990 | Butler et al. | 63/12 |
| 6,237,367 | B1 | * | 5/2001 | Cheng | 63/12 |
| 6,408,646 | B1 | * | 6/2002 | Reeves | 63/12 |

FOREIGN PATENT DOCUMENTS

| | | |
|---|---|---|
| BE | 683080 | 6/1966 |
| FR | 506940 | 12/1918 |

* cited by examiner

*Primary Examiner*—Robert J. Sandy
*Assistant Examiner*—Thomas Ho
(74) *Attorney, Agent, or Firm*—Cohen, Pontani, Lieberman & Pavane

(57) ABSTRACT

An earring comprises a decorative ring part having a first end portion to which is connected a fastening post comprising a fastening portion intended to be inserted in the hole pierced in an ear, and a fastening-free end portion. The fastening portion is inclined with respect to the first end portion by an angle α corresponding to an angle of separation of the ear lobe bearing the earring with respect to the cheek, forming a bend, so as to put the earring straight with respect to the cheek.

34 Claims, 2 Drawing Sheets

FASTENING FOR EARRINGS

FIELD OF THE INVENTION

The present invention relates to an earring comprising a decorative ring part having a first end portion to which is connected a fastening post comprising a fastening portion intended to be inserted in a hole pierced in an ear, and a fastening-free end portion. This invention also relates to a pair of earrings.

Such earrings are intended to be worn by a person having pierced ear lobes.

BACKGROUND OF THE INVENTION

Such earrings are known, which are maintained suspended from the ear by a fastening portion inserted in a pierced hole in said ear, which may either be rectilinear or curved, in particular for earrings of which the decorative part is pendant. In the latter case, the fastening post is in the form of an upturned V of which the generally curved apex forms the fastening portion intended to be placed in the hole pierced in the ear lobe. When the fastening portion is placed in position in the pierced hole, each of the two arms of the V of the fastening post is visible, since the two arms extend downwardly on either side of the pierced hole so as to cause the decorative part to descend along the cheek of the person wearing the earring.

Whatever the shape of the decorative part, the V of this fastening post is substantially included in a vertical plane, when the earring is maintained in position of use for a user in vertical position.

In the particular case of a large-hoop earring, the V lies in the mean plane of the earring, which in that case corresponds to the median plane of the decorative ring part. In this way, the fastening post lies in a vertical plane when the decorative part is in vertical position.

However, the curved fastening portion generally remains poorly positioned in the hole pierced in the ear, which, for its part, is substantially rectilinear and has a natural tendency to slide forwardly or rearwardly of the ear lobe, causing the introduction of one of the two arms of the V in the pierced hole, which is somewhat inaesthetic.

In addition, it often happens that the earrings are poorly positioned with respect to the cheeks of the person wearing them, which is inaesthetic. The shortcoming is all the greater when the decorative ring part is large and/or in the form of a ring, in particular for earrings of large-hoop type, which are desired to be parallel to the cheeks in the vicinity of the lobe, i.e. parallel to the sagittal plane of the wearer's face, the latter corresponding to the plane of symmetry of the face.

When two similar earrings are worn and in particular for large-hoop earrings, it is in that case preferable that they be parallel to each other.

It is an object of the present invention to provide an earring, which enables this aesthetic shortcoming to be avoided.

SUMMARY OF THE INVENTION

This object is attained thanks to the fact that the fastening portion is inclined with respect to the first end portion by an angle $\alpha$ corresponding to an angle of separation of the ear lobe bearing the earring with respect to the cheek, forming a bend, so as to put the earring straight with respect to the cheek.

Thus, in vertical position of use of the earring, the fastening post is not contained in a vertical plane, since the fastening portion is inclined with respect to such a plane so as to put the earring straight with respect to the cheek, but in a substantially transverse plane. In the present case, when the earring is placed in the pierced hole, the fastening post is substantially included in a plane substantially transverse with respect to the sagittal plane of the wearer's face, commonly called transverse plane of the head.

For example, for large-hoop earrings, the fastening portion is contained in a substantially horizontal plane when the decorative part is placed in a vertical plane.

In practice, the holes pierced in the ear lobes are pierced at right angles to the lobes. As for the lobes, they are more or less spaced apart from the cheeks, but are almost never (unless the ears protrude to an excessive degree) at right angles to the cheeks. Thus, the pierced hole is not parallel to the cheek, but is inclined by an angle A with respect to the cheek. In this way, by inclining the fastening portion thanks to the afore-mentioned bend, the earring is substantially parallel to the cheeks when the post is inserted in the pierced hole.

The angle $\alpha$ of the bend is advantageously chosen so that a mean plane of the decorative ring part is substantially parallel to a plane of the cheek.

In this way, the earring placed in the pierced hole is put straight and remains substantially parallel to the sagittal plane of the wearer's face and does not tend to move away therefrom.

In the following specification, the plane of the cheeks is the one which passes through the cheeks being parallel to the sagittal plane of the face.

Said bend advantageously forms an angle $\alpha$ comprised between 90° and 150°, preferably of the order of 135°.

Morphologically, the angle A is comprised between 90°, when the ears protrude to an excessive degree and 170° when the ears are flat against the head; however, this angle is generally of the order of 135°. In this way, by choosing an angle $\alpha$ of this order of magnitude, the earring is put straight when it is positioned in the ear and its mean plane is substantially parallel to the cheek of the person wearing it.

In addition, said fastening post advantageously comprises a bent portion which forms a return bend extending between said fastening portion and said fastening-free end portion. Moreover, this return bend fits behind the ear lobe, thus determining the position of fastening in the hole pierced in the lobe.

This return bend allows the fastening post to return, behind the ear, in line with the first end portion of the decorative ring part.

The return bend forms advantageously an angle $\beta$ comprised between 30° and 100° with respect to the fastening portion. It is preferably of the order of 90°, which, in addition, allows the earring to be better held against the ear lobe by exerting a slight pressure on the lobe.

Advantageously, the fastening end portion is inclined by an angle $\gamma$ with respect to said return bend and said angle $\gamma$ is chosen so that the sum of angles $\alpha$, $\beta$ and $\gamma$ is equal to 360°.

By choosing such an angle $\gamma$, the fastening post presents a free end portion, which is in the axis of the first end portion of the decorative ring part.

In this way, the fastening post is nearly invisible when the earring is being worn, since the end portions of its decorative ring part are opposite each other in line with the fastening post, i.e. for large-hoop earrings, in a plane substantially transverse with respect to the median plane of the decorative ring part. The bend is in that case nearly concealed on the front of the earring by the end of the decorative part. The same applies to the rear of the earring for the fastening-free portion, while the return bend is naturally concealed by the ear lobe. The fastening post, being generally completely housed in the pierced hole, is substantially invisible.

The fastening portion is advantageously substantially rectilinear over the whole of its length.

As the fastening portion in that case presents of the same geometry as the hole pierced in the ear lobe, namely substantially rectilinear, it does not tend to slide naturally in the latter.

In addition, when the fastening post comprises a return bend, the fastening portion is fixed in the hole between the end portion on one side of the ear lobe and the return bend on the other side.

Said fastening-free end portion is advantageously adapted to cooperate with fixing means.

Advantageously, the fixing means may be borne by a second free end portion of said decorative ring part and are adapted to cooperate by hooking with said fastening-free end portion or may be an independent element of the spring clasp type.

Said fixing means advantageously comprise a tube and said free end portion is adapted to penetrate in said tube in order to fix and close the earring.

In the case of large-hoop earrings, this system of closure of the ring is very practical and invisible in closed position, since it suffices to cause the end of the fastening and an end portion to penetrate in the rear part of the decorative ring part which is previously moved apart, when it is positioned in the hole pierced in the ear, and which is provided with a small tube intended to house the end portion or at least the free end thereof.

When the large-hoop earring is more rigid, it is more difficult to move the ring apart in order to cause the fastening to penetrate in the pierced hole. Consequently, the fastening may advantageously be fixed to the decorative ring part by a hinge. This hinge makes it possible to disengage the fastening post assembly from the earring by pivoting the latter about the hinge while remaining in a plane transverse to the mean plane of the decorative ring part and thus to make it easier to position it in the hole pierced in the ear.

The present invention also relates to a pair of earrings, of which the two rings are well arranged in the holes pierced in the ears, with the result that the aesthetic shortcoming is reduced as best possible, in particular the decorative ring parts are parallel to the sagittal plane of the wearer's face in position of use.

To that end, the pair of earrings comprises a right earring in accordance with the afore-mentioned type, a left earring in accordance with the aforementioned type, and the fastening portion of said right earring is substantially inverted with respect to the fastening portion of said left earring.

The ears being symmetrical with respect to each other, a right earring and a left earring must be available in order to be able to put the earrings straight in the respective two ears. Each of the earrings presents an afore-mentioned fastening system which is inverted from one ring to the other.

The wearer can tell from the shape of the fastening whether it is the right ring or the left ring; in particular, when the ring is placed in the hole pierced in the ear lobe, the return bend must be aimed towards the specific cheek. In addition, the ring may advantageously be marked so that the right earring and the left one can easily being differentiated.

In position of use, the decorative ring part of the right earring is advantageously substantially parallel to said decorative ring part of the left earring.

In fact, when each earring presents a mean plane then, with the two earrings in position of use, these mean planes are parallel to each other and parallel to the sagittal plane.

In this way, hooked on the ears, the decorative ring parts are substantially symmetrical to each other, when they are symmetrical with respect to each other for example with respect to a mirror plane. In addition, they are substantially parallel to each other, when they are similar to each other. In particular for large-hoop earrings, the decorative ring parts are parallel to each other and parallel to the sagittal plane.

In the case of earrings which are asymmetrical with respect to a mean plane of the decorative ring part, in particular for inverted decorative ring parts, i.e. presenting a mirror symmetry with respect to the sagittal plane, the decorative ring parts are in that case substantially symmetrical to each other with respect to the sagittal plane.

BRIEF DESCRIPTION OF THE DRAWINGS

The invention will be more readily understood on reading the following description of forms of embodiment given by way of non-limiting examples, with reference to the accompanying drawings, in which.

DESCRIPTION OF PREFERRED EMBODIMENTS

Figure 1:
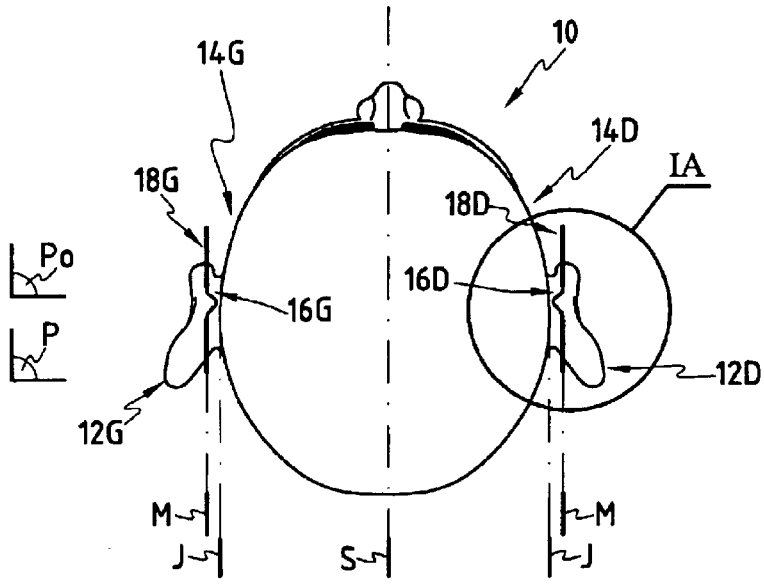
FIG. 1 is a plan view of the head of a person wearing the earrings, in a transverse plane of the face.

Referring now to the drawings, FIG. 1 shows the head 10 of a person with a right ear 12D and a left ear 12G, seen in plan view in a plane Po substantially transverse to the plane of symmetry of the wearer's face, commonly called sagittal plane S. The right ear 12D and left ear 12G are spaced from the right cheek 14D and left cheek 14G respectively, in the present case from a plane J of the cheeks, by an angle A (shown in FIG. 1A). These planes J are respectively defined as planes respectively including parts of the right and the left cheeks, in the vicinity of each of the right ear 12D, respectively the left ear 12G, these planes being parallel to the sagittal plane S.

The angle A can vary from one individual to another between 90° and 170°. These two extremes are rarely encountered. In fact, when the ears are flat against the head, the angle A is of the order of 170° and, when the ears protrude to an excessive degree, it is about 90°; however, this angle is generally of the order of 135°.

The ears are pierced at right angles to the lobe 12D and 12G of each ear, which means an inclination of each right and left pierced hole 16D, 16G respectively, by the same angle A. In this way, for the decorative part of an earring 18D or 18G, for example a large-hoop ring, to be substantially parallel to the cheek, in the present case parallel to plane J of each cheek, when it is placed in the pierced hole 16D or 16G, it must be put straight. The fastening posts of the right and left earrings 18D and 18G are therefore inverted with respect to each other, i.e. they present a mirror symmetry with respect to the sagittal plane S, with the result that, when the decorative ring parts are of the large-hoop type, they are substantially parallel in position of use. Generally, the decorative ring parts of the earrings of large-hoop type each present a mean plane M, which must therefore be rendered parallel to the sagittal plane S. In the following specification, only a right earring 18D will be described in detail.

Figure 1A:
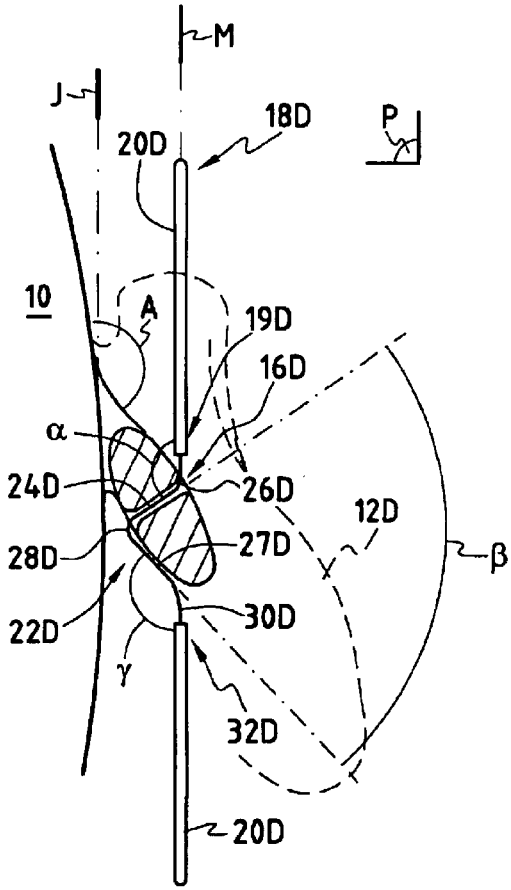
FIG. 1A is an enlargement of FIG. 1 (detail IA) schematically showing a part of the right earring, in the transverse plane of the face.

FIG. 1A shows, on a larger scale, a partial section in the vicinity of the lobe of the right ear 12D, with its right pierced hole 16D and a right large-hoop ring 18D positioned in the right hole 16D, this ring 18D being closed. The right ring 18D comprises a right decorative ring part 20D having a first end portion 19D, to which is connected a right fastening post 22D which extends in a part of the cylindrical envelope of the decorative ring part 20D. Being given the relative small length of the fastening post, this part of the cylindrical envelope containing the latter may be assimilated to a plane.

In order to be able to put the decorative ring part 20D straight with respect to the plane J of the cheek 16D, it is preferable to act on the spacing of the fastening post 22D with respect to the first end portion 19D. To that end, the plane containing the right fastening post 22D referenced P is substantially transverse with respect to the mean plane M. In position of use, the plane P containing the fastening posts is substantially parallel to the transverse plane Po.

The right fastening post 22D comprises a substantially rectilinear right fastening portion 24D which is inserted in the right pierced hole 16D. The right fastening portion 24D comprises a bend 26D presenting an angle $\alpha$ in the transverse plane P. According to the invention, the angle $\alpha$ is similar to angle A corresponding to the spacing of the ear lobes and therefore of the pierced holes. The angle $\alpha$ is thus chosen between 90° and 150°, preferably of the order of 135°, which corresponds to the average of the spacings observed, with the result that the mean plane M of the decorative ring part 20D is parallel to the plane J of each cheek 14D, 14G and to the sagittal plane S, as illustrated in FIG. 1.

The right fastening post 22D advantageously comprises a bent portion 27D which forms a right return bend 28D at angle $\beta$ with respect to the fastening portion 24D and which extends between the right fastening portion 24D and a right fastening-free end portion 30D. The angle $\beta$ is comprised between 30° and 100°, preferably of the order of 90°. The right return bend 28D makes it possible, inter alia, to hold the large-hoop ring against the lobe of the right ear 12D. When the earring 18 is not a large-hoop ring, but a ring which does not come back on itself, the right fastening-free end portion 30D of the right fastening post 22D can stop in the vicinity of the right fastening portion 24D.

Particularly in the case of large-hoop rings, the right fastening-free end portion 30D is advantageously inclined by an angle $\gamma$ comprised between 110° and 240°, preferably of the order of 135°. In fact, angle $\gamma$ is preferably chosen so that angles $\alpha$, $\beta$ and $\gamma$ are substantially included in the transverse plane P and that their sum is substantially equal to 360°, in order that, in the case of large-hoop earrings, the right fastening-free end portion 30D comes opposite a right second end portion 32D.

Figure 2:
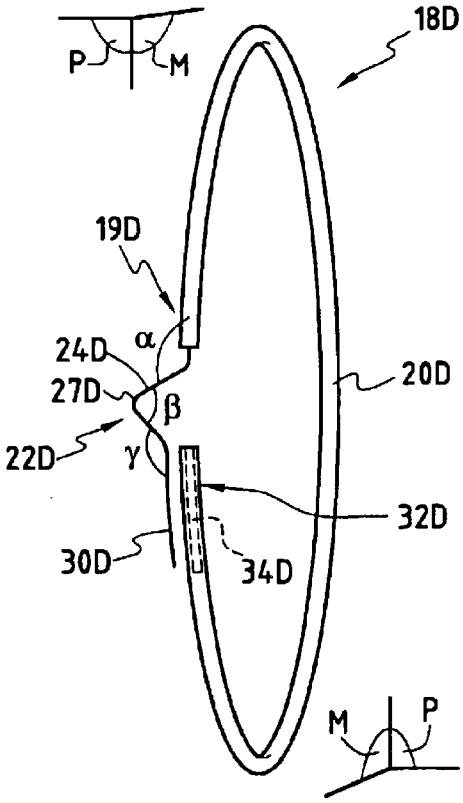
FIG. 2 is a view in perspective of an open right earring.

FIG. 2 shows a right large-hoop earring 18D of which the decorative ring part 20D is very fine, with the first end portion 19D located opposite the right second end portion 32D; this earring can be elastically deformed for its attachment in the hole pierced in the ear. The fastening post 22D is connected to the first end portion 19D and comprises the fastening portion 24D, the return bend 28D and the right fastening-free end portion 30D, as described hereinabove and in particular separated by angles $\alpha$, $\beta$ and $\gamma$. The right fastening-free end portion 30D extends freely from the return bend 28D over a length intended to be introduced in a tube 34D of specific length, advantageously made in the right second end portion 32D of the decorative ring part 20D.

In order to close the large-hoop earring 18D, it suffices to insert the right fastening-free end portion 30D in the tube 34D. In this way, the fastening means comprise the tube 34D which contains the right fastening-free end portion 30D, when the large-hoop ring 18D is closed, but it may be envisaged, particularly for earrings which are not in the form of large hoops, that the fastening means comprise a spring clasp (not shown), which slides over a right fastening-free end portion 30D, is then blocked by action of the springs on this right end portion 30D. The fastening post 22D may be connected to the first end portion 19D by welding or any other fastening means.

Figure 3:
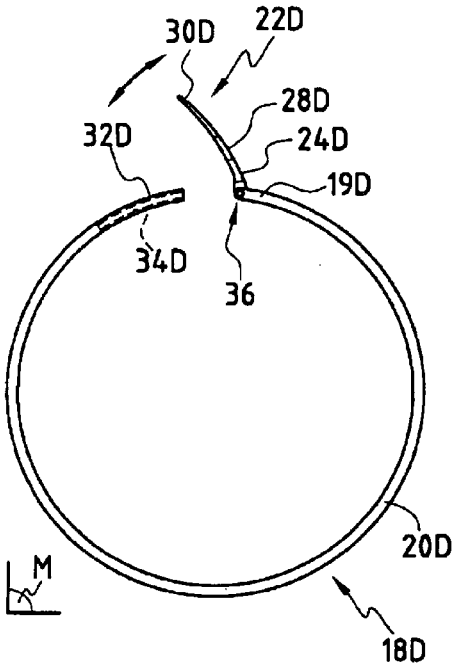
FIG. 3 is a side view of an open right earring.

When the large-hoop earring 18D is more rigid, in particular when the section of the decorative ring part 20D is greater or comprises decorative portions extending on either side of the mean plane of the earring 18D, it is more difficult to deform the ring in order to insert the right fastening-free end portion 30D into the tube 34D, as represented in FIG. 3.

In that case, it is preferable to provide the fastening post 22D with a hinge 36, which makes it possible to space the fastening post 22D apart from the decorative ring part 20D. In this way, when the large-hoop earring 18D is positioned in the pierced hole 16D (not shown in this Figure), it suffices to move the fastening post 22D outwardly with respect to the decorative ring part 20D, for example, to insert the fastening portion 24D in the pierced hole 16D, then bring the fastening post 22D and the decorative ring part 20D together by inserting the right fastening-free end portion 30D into a tube 34D for example when the same fastening means are employed.

The fastening means may also comprise a hook system (not shown). The hook system allows the earring to be closed with the aid of the fastening-free end which is joined to a hook fixed on the right second end portion 32D which no longer presents a tube 34D.

In the presence of the hinge 36, the bend 26D is spaced apart with respect to the first end portion by a fixed angle $\alpha$, which is not to be compared with the angle of opening/closure of the fastening post with respect to the decorative ring part 20D.

In practice, all the angles $\alpha$, $\beta$ and $\gamma$ are substantially included in the same plane P, which, when the fastening-free end portion 30D is hooked to the second end portion 32D, is substantially at right angles to the mean plane M of the earring, when the latter presents one and merges with the transverse plane Po of the head when the earring 18D is placed in the pierced hole 16D, as illustrated in FIG. 1.

In the presence of such a hinge 36, this plane P is adapted to pivot about the latter 36, always remaining substantially transverse to the sagittal plane S and to the mean plane M in the case of a large-hoop earring 20D, but in that case moving away from the transverse plane Po of the head (FIG. 1).

Figure 4:
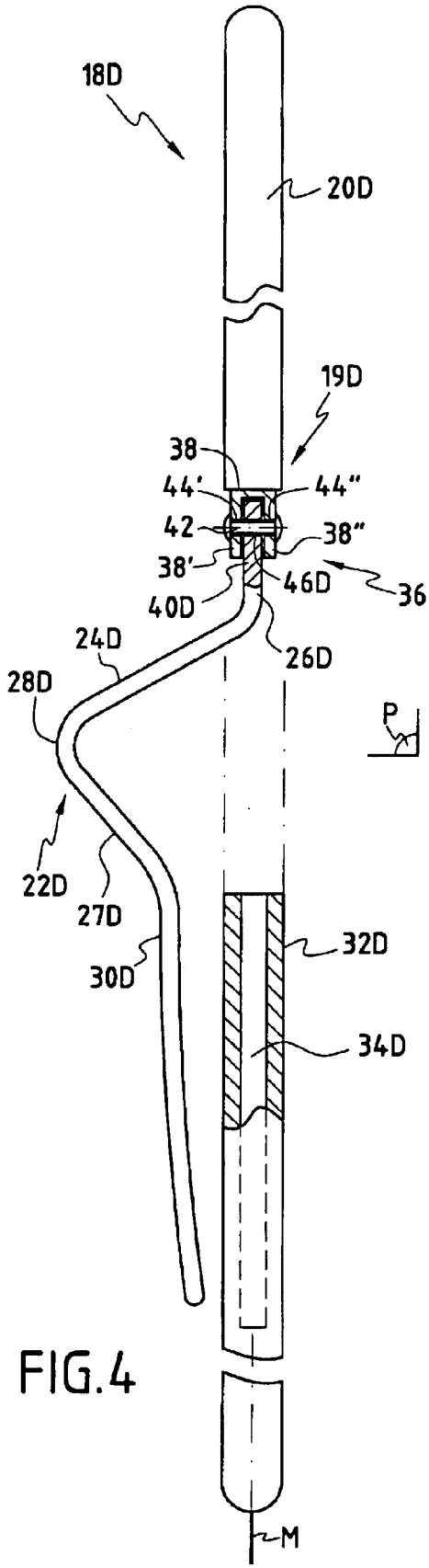
FIG. 4 is a partial section through a closed right earring seen from above in the transverse plane.

FIG. 4 shows an example of a hinge 36 in detail. The hinge 36 comprises a fork 38 having two lips 38' and 38", fixed to the first end portion 19D, by welding for example.

The fork 38 is advantageously in the form of a U open towards the outside of the first end portion 19D, in which an end 40D of the bend 26D (opposite the fastening-free end 30D), is inserted, being held by rotation with the aid of a pin 42 fixed in bores 44' and 44" made respectively in the lips 38' and 38" and passing through the end 40D through a bore 46D.

What is claimed is:

1. An earring comprising:

a suspendable decorative ring, said decorative ring defining a mean plane of the ring and having a first end portion; and an attachment portion depending from said first end portion of the decorative ring and comprising a unitary member having a first elongated substantially rectilinear portion extending at a first angle (α) relative to said first end portion of the decorative ring a second elongated substantially rectilinear portion connected to said first elongated portion to form an angular return bend that defines a second angle (β) between said first and second elongated portions of said unitary member, and a third elongated substantially rectilinear portion connected to said second elongated portion to form a second angular bend that defines a third angle (γ) between said second and third elongated portions of the unitary member, said third angle (γ) being selected so that said third elongated portion extends in a plane substantially parallel to said mean plane of the decorative ring, wherein said first elongated portion extends in a direction out of the mean plane of the ring.

2. An earring in accordance with claim 1, wherein said second angle (β) is approximately 90°.

3. An earring in accordance with claim 1, wherein said second and third angles being selected so that a sum of said first, second and third angles is approximately 360°.

4. An earring in accordance with claim 1, said third angle (γ) being selected so that said third elongated portion lies substantially in said mean plane of the decorative ring.

5. An earring in accordance with claim 1, wherein said first angle (α) is in the range of approximately 90° to 150°.

6. An earring in accordance with claim 1, wherein said second angle (β) is in the range of approximately 30° to 100°.

7. An earring in accordance with claim 3, wherein said second angle (β) is in the range of approximately 30° to 100°.

8. An earring in accordance with claim 1, wherein said decorative ring further comprises a second end portion and a fastening means for detachable engagement with a free end of said unitary member remote from said decorative ring first end portion to thereby prevent unintended disengagement of the earring from the user ear lobe.

9. An earring in accordance with claim 3, wherein said decorative ring further comprises a second end portion and a fastening means for detachable engagement with said third portion of the unitary member to thereby prevent unintended disengagement of the earring from the user ear lobe.

10. An earring in accordance with claim 4, wherein said decorative ring further comprises a second end portion and a fastening means for detachable engagement with said third portion of the unitary member to thereby prevent unintended disengagement of the earring from the user ear lobe.

11. An earring in accordance with claim 8, wherein said fastening means comprises a substantially hollow portion defined at said second end portion of the decorative ring for receiving in said hollow portion the free end of said unitary member.

12. An earring in accordance with claim 9, wherein said fastening means comprises a substantially hollow portion defined at said second end portion of the decorative ring for receiving in said hollow portion a free end of said unitary member.

13. An earring in accordance with claim 10, wherein said fastening means comprises a substantially hollow portion defined at said second end portion of the decorative ring for receiving in said hollow portion a free end of said unitary member.

14. An earring in accordance with claim 1, wherein said first angle (α) is approximately 135°.

15. An earring in accordance with claim 14, wherein said second angle (β) is approximately 90°.

16. An earring in accordance with claim 1, wherein the earring further comprises a hinge that connects the unitary member to the first end portion of the decorative ring.

17. An earring in accordance with claim 16, wherein said hinge is configured for enabling pivoted rotation of the unitary member relative to the decorative ring about an axis defined transverse to the mean plane of the decorative ring.

18. An earring in accordance with claim 1, wherein a portion of said unitary member defines a plane substantially transverse to the mean plane of the decorative ring.

19. An earring in accordance with claim 3, wherein a portion of said unitary member defines a plane substantially transverse to the mean plane of the decorative ring.

20. An earring comprising:

a suspendable decorative part, said decorative part defining a plane of suspension of the decorative part; and an attachment portion depending from said decorative part comprising a unitary member having a first elongated substantially rectilinear portion extending at a first angle (α) relative to said suspension plane of the decorative part, a second elongated substantially rectilinear portion connected to said first elongated portion to form an angular return bend that defines a second angle (β) between said first and second elongated portions of said unitary member, and a third elongated substantially rectilinear portion connected to said second elongated portion to form a second angular bend that defines a third angle (γ) between said second and third elongated portions of the unitary member, said third angle (γ) being selected so that said third elongated portion extends in a plane substantially parallel to said suspension plane of the decorative part.

21. An earring in accordance with claim 20, wherein said first elongated portion extends in a direction out of the suspension plane of the decorative part.

22. An earring in accordance with claim 20, wherein said second angle (β) is approximately 90°.

23. An earring in accordance with claim 20, wherein said unitary member further comprises a third elongated substantially rectilinear portion connected to Said second elongated portion to form a second angular bend that defines a third angle (γ) between said second and third elongated portions of the unitary member, said second and third angles being selected so that a sum of said first second and third angles is approximately 360°.

24. An earring in accordance with claim 20, wherein said unitary member further comprises a third elongated substantially rectilinear portion connected to said second elongated portion to form a second angular bend that defines a third angle (γ) between said second and third elongated portions of the unitary member, said third angle (γ) being selected so that a sum of said first, second and third angles is approximately 360°.

25. An earring in accordance with claim 20, and third angle (γ) being selected so that said third elongated portion lies substantially in said suspension plane of the decorative part.

26. An earring in accordance with claim 20, wherein said first angle (α) is in the range or approximately 90° to 150°.

27. An earring in accordance with claim 20, wherein said second angle (β) is in the range of approximately 30° to 100°.

28. An earring in accordance with claim 23, wherein said second angle (β) is in the range of approximately 30° to 100°.

29. An earring in accordance with claim 20, wherein said first angle (α) is approximately 135°.

30. An earring in accordance with claim 29, wherein said second angle (β) is approximately 90°.

31. An earring in accordance with claim 20, wherein the earring further comprises a hinge that connects the unitary member to the decorative part.

32. An earring in accordance with claim 31, wherein said hinge is configured for enabling pivoted rotation of the unitary member relative to the decorative part about an axis defined transverse to the suspension plane of the decorative part.

33. An earring in accordance with claim 20, wherein a portion of said unitary member defines a plane substantially transverse to the suspension plane of the decorative part.

34. An earring in accordance with claim 23, wherein a portion of said unitary member defines a plane substantially transverse to the suspension plane of the decorative part.

* * * * *